United States Patent [19]

Watson

[11] Patent Number: 4,890,203

[45] Date of Patent: Dec. 26, 1989

[54] IDENTITY LIGHT

[76] Inventor: Thomas J. Watson, 312 Cheryl, White Rock, N. Mex. 87544

[21] Appl. No.: 250,922

[22] Filed: Sep. 29, 1988

[51] Int. Cl.[4] ..... A45B 3/02; A63B 15/02

[52] U.S. Cl. ..... 362/102; 362/32; 362/202; 362/206; 200/571; 273/84 R

[58] Field of Search ..... 362/26, 32, 102, 109, 362/178, 201, 202, 206; 273/84 R; 200/66, 155 A, 155 R, 252, 567, 570, 571; 40/553, 610, 612

[56] References Cited

U.S. PATENT DOCUMENTS

| | | | |
|---|---|---|---|
| 786,040 | 3/1905 | Liberman et al. | 273/84 |
| 1,130,355 | 3/1915 | Von Eschen et al. | 273/84 |
| 1,908,662 | 5/1933 | Geier | 362/102 |
| 2,166,864 | 7/1939 | Gelardin | 40/553 |
| 2,242,981 | 5/1941 | Pedersen | 362/32 |
| 2,245,349 | 6/1941 | Lombardi | 362/102 |
| 3,176,092 | 3/1965 | Lukasek | 200/155 R |
| 3,777,136 | 12/1973 | Okuda | 362/102 |
| 3,796,869 | 3/1974 | Stone | 362/812 |
| 4,031,381 | 6/1977 | Carver | 362/102 |
| 4,208,701 | 6/1980 | Schock | 362/102 |
| 4,231,077 | 10/1980 | Joyce et al. | 362/32 |
| 4,345,305 | 8/1982 | Kolm et al. | 362/102 |
| 4,429,352 | 1/1984 | Griffin | 362/109 |
| 4,479,171 | 10/1984 | Mains | 362/102 |
| 4,600,974 | 7/1988 | Lew et al. | 362/102 |
| 4,737,892 | 4/1988 | Ohashi | 200/60 |
| 4,744,013 | 5/1988 | Lee et al. | 362/109 |
| 4,768,138 | 8/1988 | Leopoldi et al. | 362/202 |

*Primary Examiner*—Ira S. Lazarus
*Assistant Examiner*—Alan Cariaso
*Attorney, Agent, or Firm*—James E. Snead

[57] ABSTRACT

A self contained, hand held light in the form of a baton having a handle of cylindrical contruction that forms a battery compartment therewith. A bottom cap is removably received for closing the lower end of the handle and for actuating a switch means that is connected to be actuated by the cap. A bulb is supported at the upper end of the handle, and circuitry for the bulb supplies current flow from a storage battery by a conductor strip that is bent at the opposed marginal ends into a switch and a bulb holder. A hollow light transmitting cylinder is attached to the upper end of the handle, and a solid nose piece is attached to the upper end of the cylinder. This provides a water-proof device that is useful of signaling, controlling crowds, and illuminating dark areas.

30 Claims, 2 Drawing Sheets

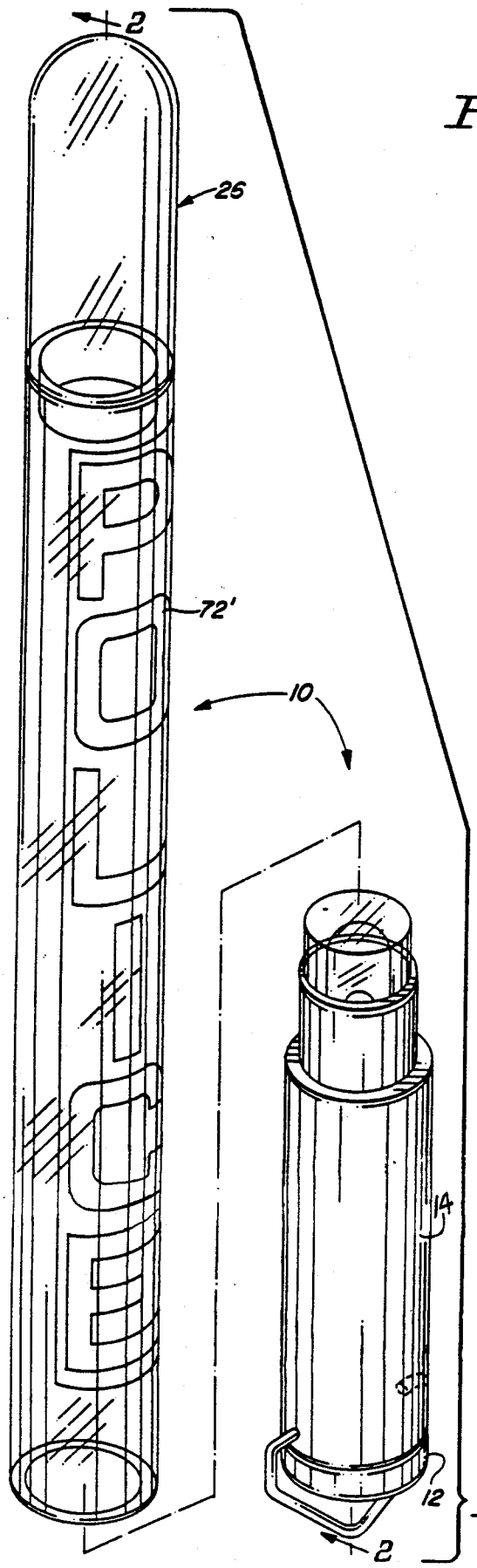
FIG. 1
FIG. 2
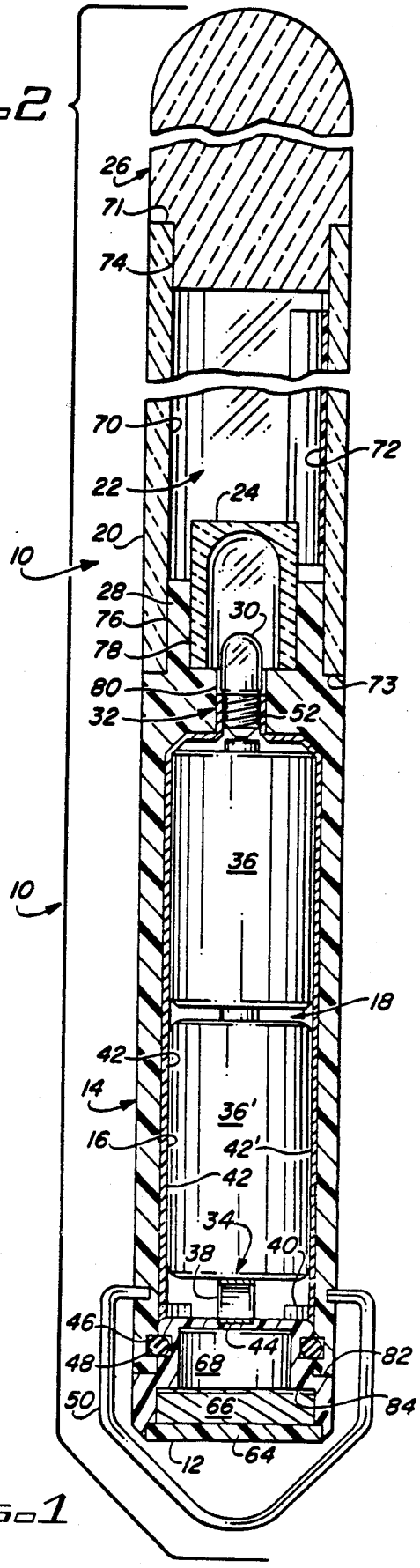

IDENTITY LIGHT

BACKGROUND OF THE INVENTION

Battery powered lights come in all sorts of configurations as evidenced by the prior art cited herein. Battery powered lights, such as flashlights, are handy to have when no other light is available and one must illuminate an object for one reason or another. Ordinary flashlight, however, do not meet all of the requirements for signaling or identifying the presence of people for identifying a person, such as a policeman for example. Sometimes several different designs of flashlights are required in order to achieve all of the desirable goals required during an emergency such as frequently encountered by a policeman, for example. Furthermore, it is cumbersome for anyone to have to carry several different battery powered light emitting devices on their person in order to have available all of the illuminating devices needed for all occasions.

It would be desirable to have made available a battery powered light emitting device that is self contained and meets most of the requirements indicated above. Such a device should be in the form of a baton, having a center of gravity arranged to provide a comfortable feel, with there being an elongated, tubular, illuminated part of the flashlight used for identification, a magnifier, and heavy opposed ends that makes the flashlight useful as an illuminated riot control device.

Such an apparatus would desirably include a state of the art incandescent bulb and a new improved switching contacts by which the bulb is energized in a new and reliable manner. A water-proof light that achieves all of these beneficial goals is the subject of the present invention.

SUMMARY OF THE INVENTION

A battery powered, hand held, light device in the form of an illuminated baton, comprising, an outer housing that is divided into a handle at the lower marginal end thereof and an illuminated cylinder at the upper end thereof. The baton has a rotatable cap at the lower terminal end of the handle that actuates an improved switch apparatus. The handle is hollow to enable a battery compartment to be formed therewithin. The handle is connected to a hollow light transmitting cylinder having an interior within which indicia is removably received. A solid upper section is affixed to the upper end of the hollow cylinder that ideally arranges the center of gravity of the device at the most desirable location, provides a light emitting member, and also serves as a magnifying glass.

The switch is of novel design and comprises a rotatable blade device actuated by the lower cap member. The switch blade is in the form of a piece of metal bowed or bent into a triangular configuration having an apex for contacting the negative end of the storage cells and opposed ends at the base thereof made into contacts that wipingly engage the lower ends of two conducting legs. The legs are affixed to and extend longitudinally of the housing and terminate at the upper end thereof in the form of a bulb holder, and terminate at the lower end thereof in opposed circumferentially extending contacts that are arranged to electrically engage the contacts at the ends of the blade. The uppermost terminal of the batteries contact the center terminal of the bulb.

The handle section houses at least one battery. The conducting legs are in the form of a strip conductor attached to or imbedded within the interior wall of the hollow battery holder and extends from the lower end of the handle to the upper end thereof. The base of the bulb is supported by the bulb holder formed at the upper marginal ends of the elongated strip conductors. Accordingly rotation of the handle cap rotates the switch blade from a non-conducting into a conducting configuration whereupon current flows from the positive battery terminal directly to the terminal of the bulb; and, from the negative battery base directly to the switch blade and from the blade, across the contacts, up the strip conductors, to the bulb holder and to the base of the bulb, thereby illuminating the filament thereof.

A primary object of the present invention is the provision of an illuminated baton having a weight distribution that provides a balanced weapon.

Another object of the invention is the provision of an improved electrical switch apparatus for an illuminated battery powered baton.

A further object of this invention is to disclose and provide an illuminated baton having removable indicia associated with an illuminated cylinder thereof.

An additional object of this invention is the provision of an illuminated baton having an elongated light emitting cylinder attached to a solid transparent marginal end.

An additional object of this invention is the provision of a water-proof, illuminated baton having an elongated light emitting cylinder, a solid, transparent, marginal end connected to the cylinder, an elongated battery compartment at the end opposed to the solid marginal end, and a switch device operated by a cap located at the lower terminal end thereof.

Another and still further object of the present invention is the provision of a decorated baton having a light emitting cylinder in the form of a transparent tube which is illuminated by an incandescent bulb powered by a battery, with the batteries being located in one marginal end thereof and the light emitting cylinder being disposed at the other marginal end of the baton.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

BRIEF DESCRIPTION OF THE DRAWINGS

FIG. 1 is a perspective side view of a baton made in accordance with the present invention;

FIG. 2 is an enlarged, broken, part cross-sectional, view taken along line 2—2 of FIG. 1;

DETAILED DESCRIPTION OF THE PREFERRED EMBODIMENT

Figure 3:
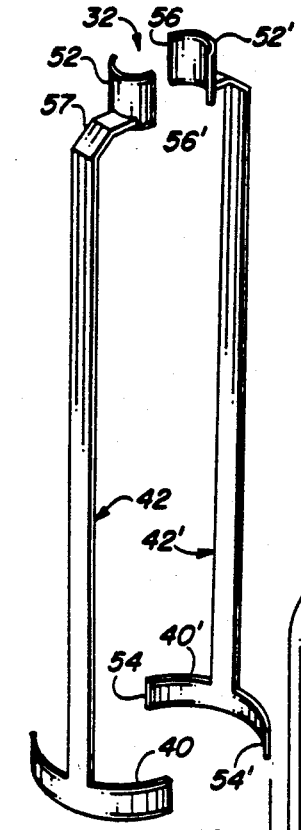
FIG. 3 is a detailed view of part of the apparatus disclosed in FIG. 2.
Figure 3:
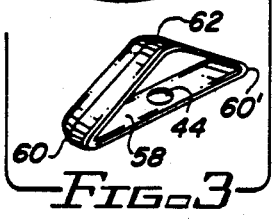

In FIGS. 1 and 2 of the drawings there is disclosed an identity light 10 made in accordance with the present invention. The light 10 is in the form of an elongated baton and has a bottom cap 12 that is rotatable in order to actuate a switch, as will be more fully disclosed hereinafter. The cap is located at the bottom of a handle section 14. A storage battery case 16 is located within an enclosure 18 for receiving a plurality of storage batteries therein.

Numeral 20 indicates a hollow cylindrical light transmitting body through which light is conducted from a bulb cover 24 towards a solid nose piece 26. The bulb cover 24 extends into the hollow interior 22. The nose piece 26 is a solid upper section that is mounted at the upper marginal end of the cylinder 20 and adjusts the balance or center of gravity of the device 10.

Numeral 28 indicates a reduced diameter, marginal end portion of handle 14. Bulb 30 is mounted concentrically within the handle 14 and bulb cover 24 by means of a novel conductive bulb holer 32. Switch assembly 34, made in accordance with this invention, underlies the storage cells 36, 36' and includes a rotatable switch blade 38 placed in electrical contact with the negative or lower surface of the cells 36. Conductor contacts 40 are located at the lower terminal ends of the elongated strip conductors 42, while the before mentioned bulb holder 32 is located at the upper terminal end of the strip conductors 42, 42'. The bulb holder 32 and contacts 40 are made integrally with the strip conductors 42 and result from bending and deforming the marginal ends of the strip conductors into the illustrated configurations at the opposed marginal ends thereof.

As best seen in FIGS. 3–7, together with other figures of the drawings, the triangular switch blade 38 is apertured at base 44 so that it can be secured within the illustrated slot formed in the bottom cap 12. O-ring groove 46 extends about the cap 12 and receives O-ring 48 therein so that the cap is rotatably secured in a sealed manner respective to the battery case 14. D-ring 50 provides a means by which the identity light can be secured to one's belt or the like.

In FIG. 2, together with other figures of the drawings, a bulb receptacle 52 is formed by the illustrated bent-up marginal ends of the strip conductors 42 and forms a unitary bulb holder, conductor, and switch element. Numeral 54 indicates the opposed ends of the contacts 40, 40'. Numeral 56 indicates the opposed ends of the bulb holder 52. The bulb holder is part of the strip conductor and is formed by the bent-up portion 57 that is received in a complementary configured, longitudinally extending groove of the battery section 14. Base 58 of the switch blade is formed into a triangular configuration at opposed ends 60, 60' thereby providing a resilient apex 62 located above the base 58. The apex 62 forms a bow which resiliently engages the lower surface of a cell, while the opposed sides 60, 60' of the base resiliently engage the interior surface of the contacts 40, 40'.

The cap 12 has a magnetic member 64 attached to reduced diameter part 66 and forms the illustrated cavity 68. Inner surface 70 of the cylinder 20 receives fluorescent lettering on a support sheet 22. The letters can be made removable and individually applied to the surface of the cylinder 20 if desired.

In FIG. 2, the solid nose 26 is reduced in diameter at 74 to provide a shoulder against which the uppermost end 71 of the upper hollow section 26 is abuttingly received. The upper marginal end of the battery section or handle 14 is reduced in diameter at 76 and forms a shoulder against which the lower edge portions 73 of the cylinder 20 is abuttingly received. The cover 24, which is received within cavity 78, receives the marginal end of the glass envelope of the bulb 30 therewithin. Passageway 80 receives the bulb holder 32 tightly therein to support the bulb 30 at a location where it extends into the interior of the cavity 24 sufficiently to efficiently illuminate the interior of cover 24 which in turn suitably illuminates the hollow cylinder so that light is dispersed from the solid nose.

The bottom cap 12 includes an outer member that forms a shoulder at 82 and 84. The end of the handle 14 is received against shoulder 82 while the before mentioned member 66 is tightly received against the shoulder 84 leaving the before mentioned cavity 68 formed therewithin.

Figure 8:
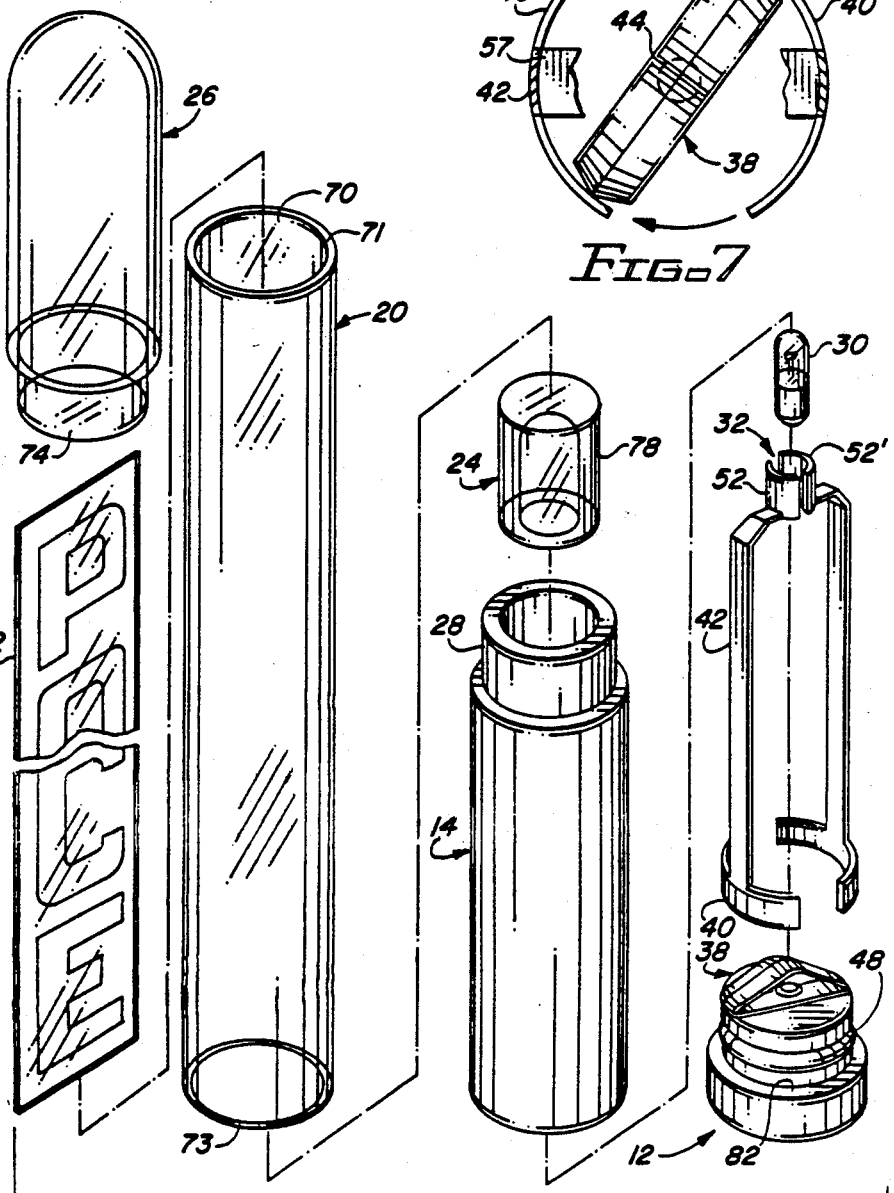
FIG. 8 is a reduced, disassembled view of the apparatus disclosed in FIGS. 1 and 2; and, FIG. 9 is a detail of part of the apparatus disclosed in FIGS. 1, 2, and 8.

In operation, the baton light of the present invention is assembled from the component parts of FIG. 8 into the watertight assembled configuration set forth in FIG. 2. The cells 36, 36' can be one or more but preferably are two "D" cells arranged in series relationship in the illustrated manner of FIG. 2. The cells are easily replaced by removing the bottom cap 12. The cells slide out of the enclosure 18, clearing the contacts 40, 40'.

The indicia 72 is easily replaced by removing the nose plug 26 or detaching cylinder 20 from handle 14 and sliding the rectangular sheet of material therefrom. The lower marginal end of the rectangular sheet 72 is captured within the annulus between wall 70 and the exterior wall of 24.

Individual letters 72' can be removably affixed to the interior or exterior wall surface with the individual letters being removably received within a depression formed in the surface thereof.

The bulb 30 is easily replaced by removing the cylinder 20, the cover 24, and then unscrewing the bulb from the bulb holder formed by the coacting members 52, 52'.

The nose plug 26 can be of any desired length and provides a magnifying glass as well as a transparent mass at the upper marginal end of the light 10 that preferably is of a weight to counterbalance the weight of the "D" cells 36, 36'. This results in a solid nose piece 26 approximately eight inches in length.

Figure 4:
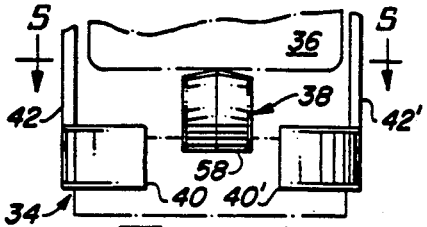
FIGS. 4 and 6 are broken, side elevational views of part of the apparatus disclosed in FIGS. 2 and 3.
Figure 6:
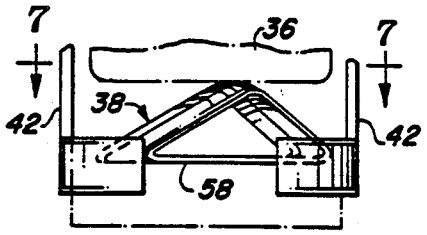
Figure 5:
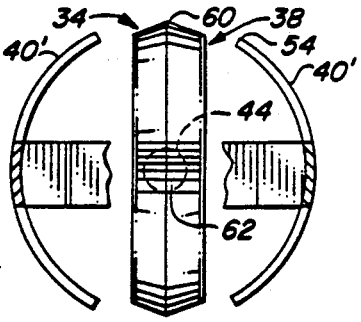
FIGS. 5 and 7 are top, plan views of FIGS. 4 and 6, with some parts being broken away therefrom in order to more clearly disclose the apparatus.
Figure 7:
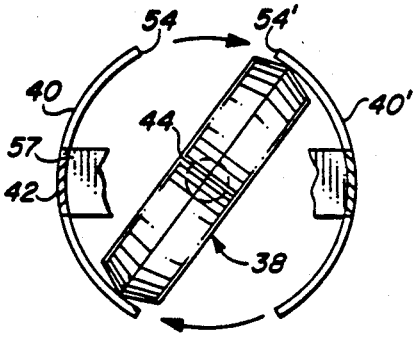
Figure 9:
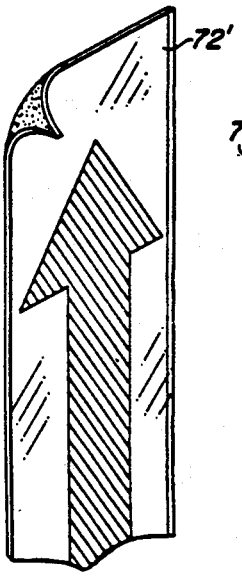

The switch assembly of FIGS. 2 and 4 are illustrated in the off position while the switch assembly of FIGS. 6 and 7 are in the "on" position. The switch is turned off by rotating the bottom cap 12, thereby rotating the blade assembly 38 into the position of FIG. 4 or into the position of FIG. 5.

The apparatus of the present invention is hermetically sealed and is therefore water-tight and can be used in all sorts of environments including scuba diving. The unusual appearance of the baton presented by the present invention immediately alerts and gains the attention of those in close proximity thereto. This is an especially valuable asset at traffic accidents or with disabled vehicles or in many other situations. The official indicia 72' immediately notifies a crowd of the presence of a law enforcement officer. Other indicia 72' can be utilized for similarly announcing the official capacity of other entities or for conveying information of many different sorts.

The baton of the present invention is illuminated along the cylinder 20 and the light is dissipated by the nose piece 26. The nose piece 26 further provides more intense illumination at the free end thereof.

The hollow, translucent body 20 is closed by a solid translucent nose piece 26 and can have a piece of mylar carrying a message inserted into the hollow body. The invention also contemplates a solid body with the message being engraved in the solid translucent body.

As seen in FIG. 1, the essential parts of the device consists of a nose 26 which closes a hollow translucent body 20 which is removably affixed to a battery holder and a bulb holder handle 14. The bulb holder and bulb are encased within a translucent bulb cover which has the effect of directing light from the bulb both down the hollow tube and out the nose piece and also out the sidewall of the translucent body. The battery and bulb holder handle is closed by a cap which frictionally engages the inner walls of the battery and bulb holder handle in a sealed manner so that it can be rotated in the handle. The illustrated spring switch mechanism shown in the figures of the drawings engages the electrical connector between the bulb at one end of the handle and the spring affixed to the cap at the opposite end of the handle. The spring is rotated by the handle from the on to the off position, and vice-versa. The electrical connector is a copper strip embedded in or otherwise attached to the sidewall of the handle and extends from the bulb holder at one end to the switch connector at the other end.

The nose is of translucent acrylic materials so that it will transmit light and can be used as a magnifier by holding the side of the translucent nose piece over some object to be magnified. The translucent end serves as a beacon for a device to transmit a beam of light out of the end.

A mylar message can be either removably or fixedly mounted within the hollow body member or machined onto the surface of the solid body member so that the illumination of the body member through energizing the bulb will highlight the message. The message can be made of fluorescent letters so as to glow in the dark after being illuminated by the bulb of the device.

I claim:

1. A self contained, hand held light in the form of a baton, comprising: a handle of cylindrical construction having a battery compartment formed therewithin; a bottom cap removably received in mounted relationship on said handle for closing the lower end of the handle; said cap is rotatable respective to said handle;

a switch means connected to be actuated between a conducting and non-conducting position by said cap; a bulb supported at the upper end of the handle, means providing circuitry for said bulb whereby current flow from a battery which may be stored within said battery compartment is connected for energizing the bulb when said switch means is moved into the conducting position by said cap;

said switch means includes a switch blade connected to be rotated by the cap; and circumferentially spaced elongated strip conductors supported by the handle;

the end of the strip conductors form contacts that are engaged by the switch blade; a marginal end of the strip conductors are connected to a bulb holder and electrical receptacle;

a hollow, light transmitting cylinder attached to the upper end of the handle, a solid nose piece attached to the upper end of the cylinder;

and means forming indicia is supported by said hollow cylinder while light from said bulb is propagated by said cylinder to said nose piece and thereby illuminates said nose piece.

2. The light of claim 1 wherein said conductors are secured within the handle and form circuitry by which current flows from a storage cell to the bulb.

3. The light of claim 2 wherein the base of the bulb is received by the holder formed at the upper marginal end of the conductors and the bulb terminal directly bears against the positive terminal of a battery.

4. The light of claim 3 and further including means by which indicia is provided on the cylinder wall.

5. An improved hand held light in the form of a baton having a handle of cylindrical construction at a lower end thereof and a solid nose piece at the upper end thereof; said handle having a battery compartment formed therewithin;

a rotatable cap removably received in mounted relationship on said handle for closing the lower end of the handle;

a switch means actuated between a conducting and nonconducting position in response to rotation of said cap; a bulb supported at the upper end of the handle, means providing circuitry for said bulb whereby current flow from a battery which may be stored within said battery compartment is connected for energizing the bulb when said switch means is moved into the conducting position by said cap;

said switch means comprises a switch blade supported by said cap; elongated strip conductors are supported by the handle;

one end of the strip conductors terminate in electrical contacts that are positioned to be engaged by the switch blade; the other end of the strip conductors terminate in an electrical receptacle for holding the base of said bulb and for conducting current to the base of the bulb;

a light transmitting cylinder supported by the handle, a nose piece attached to the upper end of the cylinder; said bulb is located within a lower end of said cylinder, whereby;

light from said bulb is propagated along said cylinder to said nose piece and thereby illuminates said cylinder and nose piece.

6. The light of claim 5 wherein said conductors are secured to the interior of the handle and form the circuitry by which current can flow from the storage battery, through the switch, and to the bulb.

7. The light of claim 6 wherein the bulb base is threadedly received by the electrical receptacle formed at the upper marginal end of the conductors while the bulb terminal bears against the upper terminal of the storage batteries.

8. The light of claim 7 wherein indicia is provided on a self supporting sheet of material which is removably received within the cylinder.

9. A light in the form of a baton having a handle of hollow construction at one end thereof, a cylindrical nose piece at the other end thereof, a hollow light conducting cylinder interconnecting the handle and nose piece; said handle having a battery compartment formed therewithin;

a rotatable bottom cap received in mounted relationship on said handle for closing the lower end of the handle;

a switch means connected to be actuated between a conducting and non-conducting position by said cap; a bulb supported at the upper end of the handle, means providing circuitry for said bulb whereby current flow from a battery which may be stored within said battery compartment is connected for energizing the bulb when said switch means is moved into the conducting position by said cap;

said switch means includes a switch blade in the form of a triangle having a base affixed to the cap; and two conductors supported by the handle;

one end of the conductors are formed into contacts that are engaged by the switch blade; the other end of the conductors are jointly formed into an electrical receptacle for the bulb, whereby rotation of the cap brings the switch blade into electrical contact with said one end of the conductors;

said bulb extends into said light transmitting cylinder which thereby receives light from the bulb and transfers the light to the nose piece which is attached to the upper end of the cylinder;

whereby; light from said bulb illuminates said cylinder and nose piece.

10. The light of claim 9 wherein said conductors are secured to the interior of the handle and form the circuitry so that current can flow from the battery, through the switch, to the bulb.

11. The light of claim 10 wherein the base of the bulb is received by the upper marginal end of the conductors and thereby is electrically connected to the battery by means of the switch.

12. The light of claim 11 wherein indicia is removably applied on the cylinder wall.

13. A self contained, hand held light in the form of a baton, comprising: a handle of cylindrical construction having a battery compartment formed therewithin; a bottom formed on said handle for closing the lower end of the handle; means forming a light emitting cylinder at the upper end of the handle;

a switch means connected to be actuated between a conducting and non-conducting position by relative movement between said switch means and said handle; the upper end of said handle is reduced in diameter to form a bulb holder; a bulb supported within said bulb holder and has a free marginal end extending therefrom; said bulb and the upper end of the handle being in axial aligned relationship respective to the light emitting cylinder; means providing circuitry for said bulb whereby current flow from a battery which may be stored within said battery compartment is connected for energizing the bulb when said switch means is moved into the conducting position;

said light emitting cylinder terminates in a solid nose piece attached to the upper end of the cylinder and in opposition to the upper end of the handle;

a bulb cover having a lower marginal end received within and supported by the upper marginal end of the handle, said bulb cover has a free end that extends into said light emitting cylinder;

and means forming indicia which is supported by said hollow cylinder; whereby light from said bulb is propagated by said cylinder to said nose piece and thereby simultaneously illuminates said indicia and nose piece, and provides illumination for the immediate surrounding.

14. The light of claim 13 wherein said bottom of said handle is a cap, said cap is rotatably affixed to said handle; said switch means is connected to be actuated by said cap; and an elongated strip conductor supported by the interior of the handle;

means forming the lower end of the strip conductor into a contact that is electrically engaged by the switch means; and means forming the upper end of the strip conductor into an electrical receptacle for holding the bulb.

15. The light of claim 14 wherein said conductor is secured within the handle and form circuitry by which current flows from a storage cell to the bulb.

16. The light of claim 15 wherein the base of the bulb is received by the holder formed at the upper marginal end of the conductor and the bulb terminal can directly bear against the positive terminal of a battery.

17. The light of claim 16 and further including means by which said indicia is removably provided on the cylinder wall.

18. An improved hand held light in the form of a baton having a handle of cylindrical construction at a lower end thereof and a solid nose piece at the upper end thereof; said handle having a battery compartment formed therewithin;

a closure member in the form of a cap attached at the lower end of said handle for closing the lower end of the handle;

a switch means supported by said handle and actuated between a conducting and non-conducting position; a bulb supported at the upper end of the handle, means providing circuitry for said bulb whereby current flow from a battery which may be stored within said battery compartment is connected for energizing the bulb when said switch means is moved into the conducting position of operation;

a cavity at the upper end of the handle for receiving the bulb, a bulb cover;

an elongated light transmitting cylinder having one end supported by the upper end of the handle, said nose piece is attached to the upper end of the cylinder; said bulb and said bulb cover is located axially respective to a lower marginal end of said cylinder, said bulb cover extends into said cylinder;

whereby; light from said bulb is propagated along said cylinder to said nose piece and thereby illuminates said cylinder and nose piece.

19. The light of claim 18 wherein said switch means is affixed to an inner surface of said cap; an elongated strip conductor is supported by the interior of the handle;

the lower end of the strip conductor terminates in an electrical contact that is positioned to be engaged by the switch means; the upper end of the strip conductor terminates in an electrical receptacle for holding the base of a bulb while conducting current to the base of the bulb.

20. The light of claim 19 wherein said conductor is secured to the interior of the handle and form the circuitry by which current can flow from the storage batter, through the switch, and to the bulb.

21. The light of claim 20 wherein the bulb base is threadedly received by the electrical receptacle formed at the upper marginal end of the conductor while the bulb terminal bears against the upper terminal of the storage battery.

22. The light of claim 21 wherein indicia is provided on a self supporting sheet of material which is removably received within the cylinder.

23. A light in the form of a baton having a handle of hollow construction at one end thereof, a cylindrical nose piece at the other end thereof, a hollow light conducting cylinder interconnecting the handle and said nose piece; said handle having a battery compartment formed therewithin;

a closure member at the lower end of the handle; switch means supported on said handle and connected to be actuated between a conducting and non-conducting position when actuated; a cavity at the upper marginal end of said handle, a bulb supported at the upper end of the handle and within said cavity, means providing circuitry for said bulb whereby current flow from a battery which may be stored within said battery compartment is connected for energizing the bulb when said switch means is moved into the conducting position; a bulb cover connected to said handle and received about the bulb;

said bulb extends into said light conducting cylinder which thereby receives light from the bulb and conducts some of the light to the nose piece which is attached to the upper end of the cylinder;

whereby; light from said bulb illuminates said cylinder and nose piece.

24. The light of claim 23 wherein said switch means includes a switch member having a base affixed to the cap; and an elongated strip conductor supported by the interior of the handle;

the lower marginal end of the strip conductor is formed into a contact that is engaged by the switch member; the upper marginal end of the strip conductor is formed into a support for the bulb and forms an electrical receptacle therefor.

25. The light of claim 24 wherein said conductor is secured to the interior of the handle and form the circuitry so that current can flow from the battery, through the switch, and to the bulb.

26. The light of claim 25 wherein the base of the bulb is received by the upper marginal end of the conductor and thereby is electrically connected to the battery by means of the switch.

27. The light of claim 26 wherein indicia is removably applied on the cylinder wall.

28. A self contained, hand held light in the form of a baton, comprising:

a handle of cylindrical construction having a battery compartment formed therewithin; a bottom formed on said handle for closing the lower end of the handle; means forming a light emitting cylinder at the upper end of the handle;

a switch means connected to be actuated between a conducting and non-conducting position by relative movement between said switch means and said handle; the upper marginal end of said handle is reduced in diameter to form an annular support for said light emitting cylinder; a bulb holder formed within said annular support; a bulb supported within said bulb holder and has a free marginal end extending therefrom; said bulb and the upper end of the handle being in axial aligned relationship respective to the light emitting cylinder; means providing circuitry for said bulb whereby current flow from a battery which may be stored within said battery compartment is connected for energizing the bulb when said switch means is moved into the conducting position;

said light emitting cylinder terminates in a solid nose piece attached to the upper end of the cylinder and in opposition to the upper end of the handle;

said annular support has an axial passageway that communicates with said battery compartment; a bulb cover having a lower marginal end received within and supported by the axial passageway at the upper marginal end of the handle, said bulb cover has a free end that extends into said light emitting cylinder;

and means forming indicia which is supported by said hollow cylinder; whereby light from said bulb is propagated by said cylinder to said nose piece and thereby simultaneously illuminates said indicia and nose piece, and provides illumination for the immediate surrounding.

29. An improved hand held light in the form of a baton having a handle of cylindrical construction at a lower end thereof and a solid nose piece at the upper end thereof; said handle having a battery compartment formed therewithin;

a closure member in the form of a cap attached at the lower end of said handle for closing the lower end of the handle;

a switch means supported by said handle and actuated between a conducting and non-conducting position; a bulb supported at the upper end of the handle, means providing circuitry for said bulb whereby current flow from a battery which may be stored within said battery compartment is connected for energizing the bulb when said switch means is moved into the conducting position of operation;

a cavity at the upper end of the handle having a large diameter passageway that reduces into a small diameter passageway and communicates with said battery compartment, said small diameter passageway is for receiving the bulb; a bulb cover supported within said large diameter passageway; said cavity is axially aligned with a reduced outer marginal upper end of said handle;

an elongated light transmitting cylinder having one end supported by the reduced upper end of the handle, said nose piece is attached to the upper end of the cylinder; said bulb and said bulb cover is located axially respective to a lower marginal end of said cylinder, said bulb cover extends into said cylinder;

whereby; light from said bulb is propagated along said cylinder to said nose piece and thereby illuminates said cylinder and nose piece.

30. A light in the form of a baton having a handle of hollow construction at one end thereof,a cylindrical nose piece at the other end thereof, a hollow light conducting cylinder interconnecting the handle and said nose piece; said handle having a battery compartment formed therewithin; said handle, light conducting cylinder, and nose piece are of substantially the same outside diameters;

a closure member at the lower end of the handle; switch means supported on said handle and connected to be actuated between a conducting and non-conducting position when actuated; a cavity at the upper marginal end of said handle, said cavity has a small diameter marginal length and a large diameter marginal length, a bulb supported at the upper end of the handle and within said small diameter part of the cavity, means providing circuitry for said bulb whereby current flow from a battery, which may be stored within said battery compartment, is connected for energizing the bulb when said switch means is moved into the conducting position; a bulb cover of unitary construction supported within the large part of the cavity of said handle and received about and encloses a free end of the bulb;

the upper marginal end of said handle is reduced in diameter and slidably receives the lower marginal end of said light emitting cylinder at a location adjacent to the cavity;

said bulb extends into said light conducting cylinder which thereby receives light from the bulb and conducts some of the light to the nose piece which is attached to the upper end of the cylinder;

whereby; light from said bulb illuminates said cylinder and nose piece.

* * * * *